US007782291B2

(12) United States Patent
Tung

(10) Patent No.: US 7,782,291 B2
(45) Date of Patent: Aug. 24, 2010

(54) DRIVING CIRCUIT OF LIQUID CRYSTAL DISPLAY

(75) Inventor: Chien-Fan Tung, Miao-Li (TW)

(73) Assignee: Chimei Innolux Corporation, Miao-Li County (TW)

( * ) Notice: Subject to any disclaimer, the term of this patent is extended or adjusted under 35 U.S.C. 154(b) by 1051 days.

(21) Appl. No.: 11/501,621

(22) Filed: Aug. 8, 2006

(65) Prior Publication Data

US 2007/0030235 A1 Feb. 8, 2007

(30) Foreign Application Priority Data

Aug. 8, 2005 (TW) ..... 94126755 A

(51) Int. Cl.
*G09G 3/36* (2006.01)

(52) U.S. Cl. ..... 345/100

(58) Field of Classification Search ..... 345/100
See application file for complete search history.

(56) References Cited

U.S. PATENT DOCUMENTS 5,793,346 A * 8/1998 Moon ..... 345/92
5,945,970 A * 8/1999 Moon et al. ..... 345/92
6,903,734 B2 6/2005 Eu
6,943,506 B2 * 9/2005 Moon ..... 315/323
7,015,904 B2 * 3/2006 Kim ..... 345/212
2003/0184538 A1 * 10/2003 Yamato et al. ..... 345/211

* cited by examiner

*Primary Examiner*—Sumati Lefkowitz
*Assistant Examiner*—Ke Xiao
(74) *Attorney, Agent, or Firm*—Wei Te Chung

(57) ABSTRACT

An exemplary driving circuit of a liquid crystal display includes a delay circuit (130), a first transistor (140), a second transistor (160), a first bias resistor (R1), and a second bias resistor (R2). The first transistor includes a source electrode for receiving a first voltage signal, and a drain electrode for providing the first voltage signal to a first external circuit. The second transistor includes an emitter electrode for receiving a second voltage signal, and a collector electrode for providing the second voltage signal to a second external circuit. The delay circuit includes a first control pin (137) connected to the gate electrode of the first transistor, and a second control pin (138) connected to the base electrode of the second transistor. The delay circuit is configured for delaying the first voltage signal for a first predetermined time period and the second voltage signal for a second predetermined time period.

18 Claims, 2 Drawing Sheets

DRIVING CIRCUIT OF LIQUID CRYSTAL DISPLAY

FIELD OF THE INVENTION

The present invention relates to a driving circuit of a liquid crystal display (LCD), whereby accurate control of delay time periods of voltages output by the driving circuit can be attained.

GENERAL BACKGROUND

An LCD has the advantages of portability, low power consumption, and low radiation, and has been widely used in various portable information products such as notebooks, personal digital assistants (PDAs), video cameras and the like. Furthermore, the LCD is considered by many to have the potential to completely replace CRT (cathode ray tube) monitors and televisions.

A typical LCD includes an LCD panel, a timing controller, a gate driver, and a data driver. The LCD panel includes a plurality of thin film transistors (TFTs), and a plurality of pixels, each of which is driven by a TFT. The gate driver drives the TFT by two different voltages, namely $V_{GH}$ and $V_{GL}$. The data driver provides a plurality of gray-scale voltages to the pixels via the activated TFTs.

In order to avoid the gate driver being latched up by the two different voltages $V_{GH}$ and $V_{GL}$, a delay circuit is needed to delay the voltages $V_{GH}$ and $V_{GL}$ for different predetermined time periods.

As shown in FIG. 2, a typical driving circuit 200 of an LCD includes two first delay circuits 210 and a second delay circuit 220. Each first delay circuit 210 includes a first transistor 212, a first capacitor C1, a first resistor R1, and a second resistor R2. The second delay circuit 220 includes a second transistor 222, a second capacitor C2, a third resistor R3, and a fourth resistor R4.

In each of the first delay circuits 210, the first transistor 212 is a PNP (positive-negative-positive) type transistor. A base electrode "b" of the first transistor 210 is connected to ground via the second resistor R2. The first capacitor C1 and the first resistor R1 are connected in parallel, between an emitter electrode "e" and the base electrode "b" of the first transistor 212. The emitter electrode "e" of the first transistor 212 receives a first voltage signal from a first input terminal 211. A collector electrode "c" of the first transistor 212 provides the first voltage signal to a first output terminal 213. The first voltage signal can be a voltage $V_{GH}$, or a voltage $V_{DD}$. One of the first delay circuits 210 is used to delay the voltage $V_{GH}$ a first predetermined time period T1, and then send the voltage $V_{GH}$ to a gate driver of the LCD. The other first delay circuit 210 is used to delay the voltage $V_{DD}$ a second predetermined time period T2, and then send the voltage $V_{DD}$ to a data driver of the LCD.

The second transistor 222 is an n-channel metal oxide semiconductor field effect transistor (N-MOSFET). A gate electrode "G" of the second transistor 220 is connected to ground via the fourth resistor R4. The second capacitor C2 and the third resistor R3 are connected in parallel, between a source electrode "S" and the gate electrode "G" of the second transistor 222. The source electrode "S" of the second transistor 222 receives a second voltage signal from a second input terminal 221. A drain electrode "D" of the second transistor 222 provides the second voltage signal to a second output terminal 223. The second voltage signal can be a voltage $V_{GL}$. The second delay circuit 220 is used to delay the voltage $V_{GL}$ a third predetermined time period T3, and then send the voltage $V_{GL}$ to the gate driver of the LCD.

The first and second delay circuits 210, 220 are analog circuits. The parameters of the elements of the first and second delay circuits 210, 220, such as the first and third resistors R1, R3 and the first and second capacitors C1, C2, vary in different environmental temperatures. Therefore the delay time periods T1, T2 and T3 vary with differing environmental temperatures. Thus, the delay time periods T1, T2, T3 cannot be accurately controlled.

What is needed, therefore, is a driving circuit of an LCD that can overcome the above-described deficiencies.

SUMMARY

In a preferred embodiment, a driving circuit of a liquid crystal display includes a delay circuit, a first transistor, a second transistor, a first bias resistor, and a second bias resistor. The first transistor includes a source electrode for receiving a first voltage signal, a drain electrode for providing the first voltage signal to a first circuit of the liquid crystal display, and a gate electrode. The second transistor includes an emitter electrode for receiving a second voltage signal, a collector electrode for providing the second voltage signal to a second circuit of the liquid crystal display, and a base electrode. The first bias resistor is connected between the gate electrode and the source electrode of the first transistor. The second bias resistor is connected between the base electrode and the emitter electrode of the second transistor. The delay circuit includes a first control pin connected to the gate electrode of the first transistor, and a second control pin connected to the base electrode of the second transistor. The delay circuit is configured for delaying the first voltage signal for a first predetermined time period and the second voltage signal for a second predetermined time period.

Other advantages and novel features will become more apparent from the following detailed description when taken in conjunction with the accompanying drawings.

DETAILED DESCRIPTION OF PREFERRED EMBODIMENTS

Figure 1:
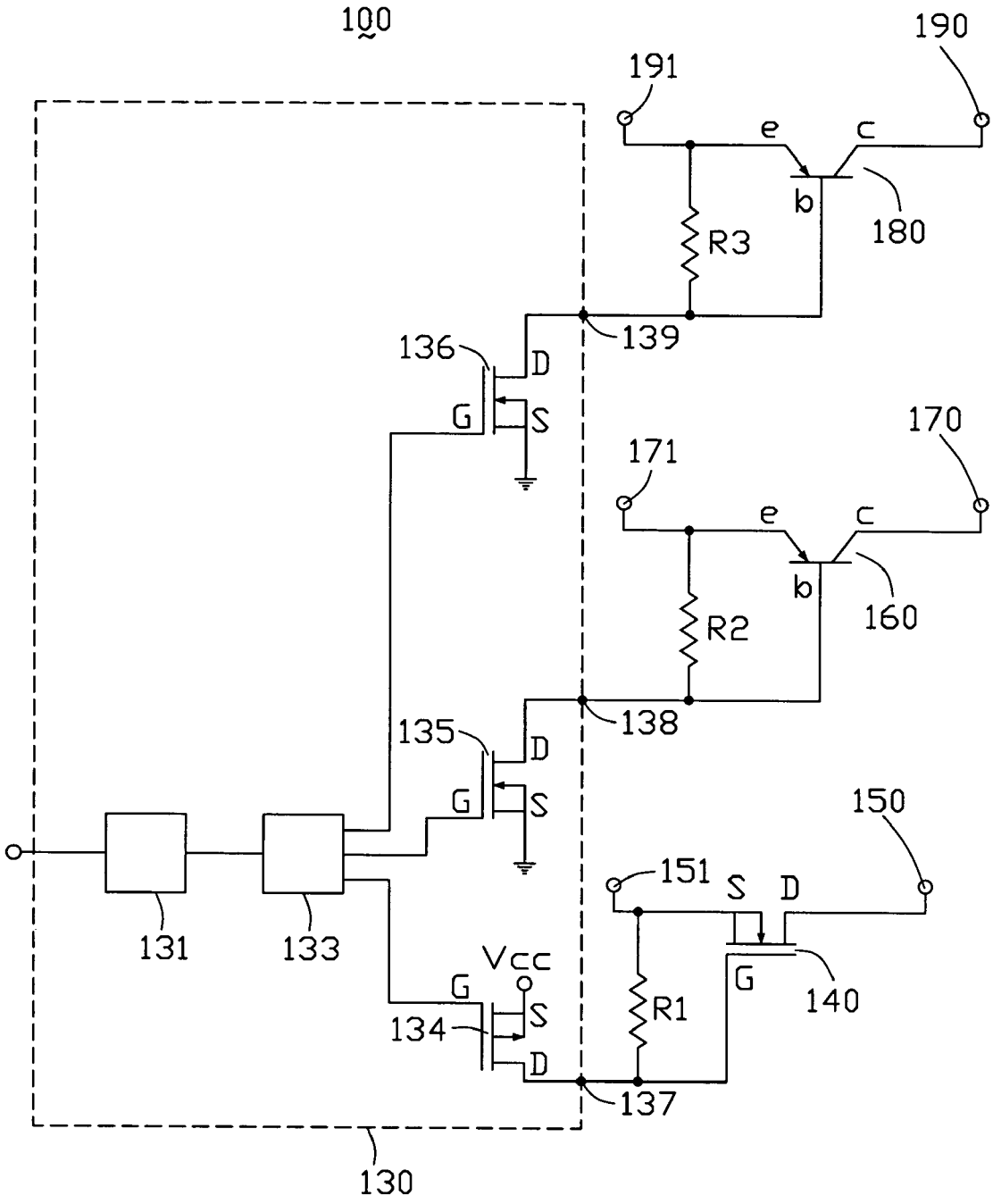
FIG. 1 is a diagram of a driving circuit of an LCD according to a preferred embodiment of the present invention.
Figure 2:
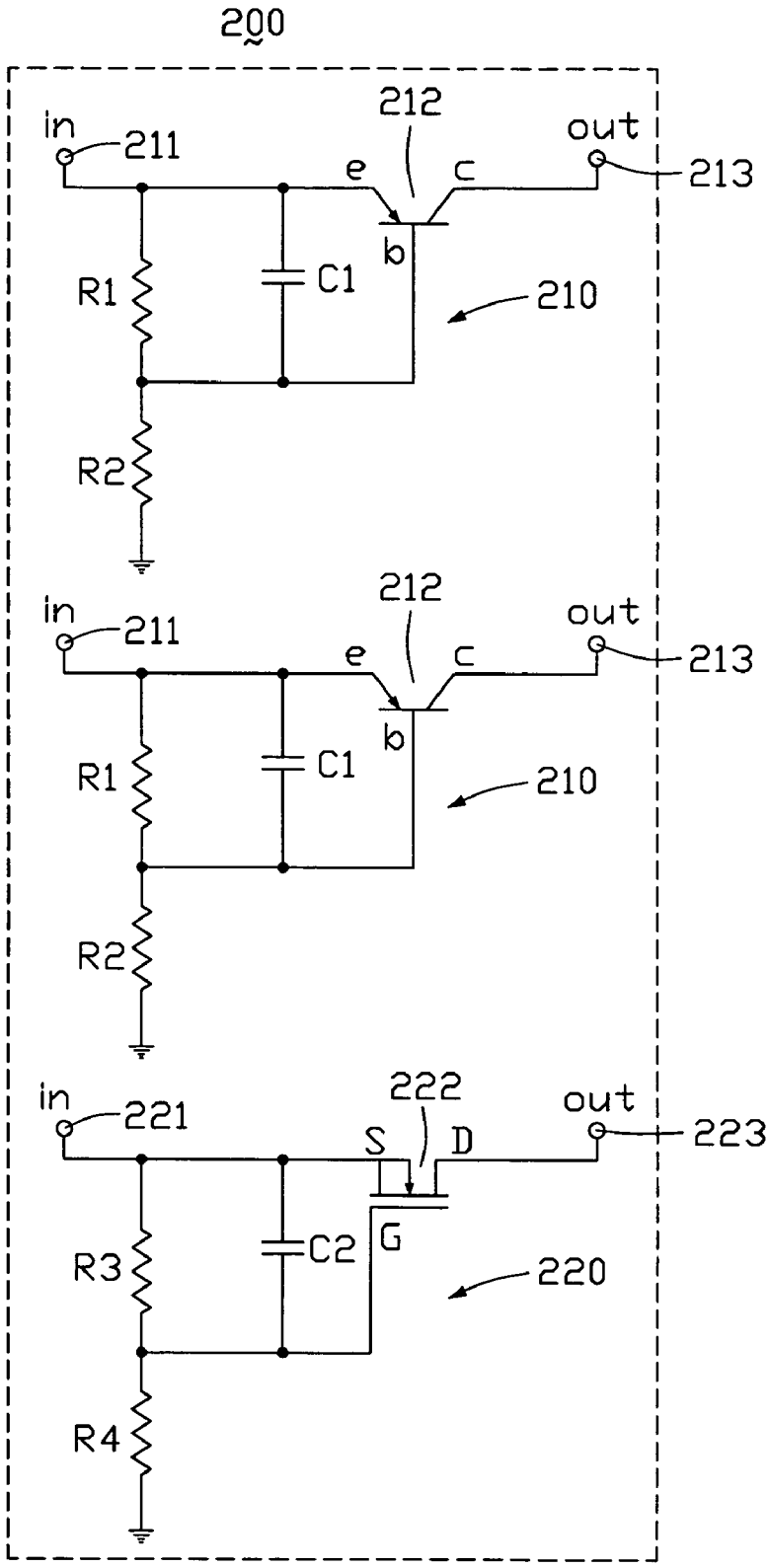
FIG. 2 (RELATED ART)
FIG. 2 is a diagram of a conventional driving circuit of an LCD.

FIG. 1 is a diagram of a driving circuit of an LCD according to a preferred embodiment of the present invention. The driving circuit 100 includes a delay circuit 130, a first transistor 140, a second transistor 160, a third transistor 180, a first bias resistor R1, a second bias resistor R2, and a third bias resistor R3. The first transistor 140 is an n-channel metal oxide semiconductor field effect transistor, or an NPN (negative-positive-negative) type transistor. The second and third transistors 160, 180 are PNP type transistors, or p-channel metal oxide semiconductor field effect transistors (P-MOSFETs).

The delay circuit 130 includes a timing controller 131, a state machine 133, a fourth transistor 134, a fifth transistor 135, and a sixth transistor 136. The fourth transistor 134 is an n-channel metal oxide semiconductor field effect transistor. The fifth and sixth transistors 135, 136 are p-channel metal oxide semiconductor field effect transistors. The delay circuit 130 is an integrated circuit that can be manufactured by incorporating the state machine 133, the fourth transistor 134, the fifth transistor 135 and the sixth transistor 136 in the timing controller 131 in a semiconductor manufacturing process.

The timing controller 131 includes an oscillator (not shown) for providing an oscillatory signal such as a square pulse signal to the state machine 133. The state machine 133 is a digital circuit, and includes a counter (not shown) for generating time delays, and three control terminals (not labeled).

The fourth transistor 134 includes a gate electrode "G", a source electrode "S", and a drain electrode "D". The gate electrode "G" is connected to a first one of the control terminals of the state machine 133. The source electrode "S" is connected to a power supply $V_{CC}$. The drain electrode "D" is defined as a first control pin 137 of the delay circuit 130.

The fifth transistor 135 includes a gate electrode "G", a source electrode "S", and a drain electrode "D". The gate electrode "G" is connected to a second one of the control terminals of the state machine 133. The source electrode "S" is connected to ground. The drain electrode "D" is defined as a second control pin 138 of the delay circuit 130.

The sixth transistor 136 includes a gate electrode "G", a source electrode "S", and a drain electrode "D". The gate electrode "G" is connected to a third one of the control terminals of the state machine 133. The source electrode "S" is connected to ground. The drain electrode "D" is defined as a third control pin 139 of the delay circuit 130.

The first transistor 140 includes a gate electrode "G", a source electrode "S", and a drain electrode "D". The first bias resistor R1 is connected between the gate electrode "G" and the source electrode "S". The gate electrode "G" is connected to the first control pin 137 of the delay circuit 130. The source electrode "S" receives a first voltage signal from a first input terminal 151. The drain electrode "D" provides the first voltage signal to a gate driver (not shown) of the LCD via a first output terminal 150. The first voltage signal can be a voltage $V_{GL}$ that is approximately equal to −5 volts.

The second transistor 160 includes a base electrode "b", an emitter electrode "e", and a collector electrode "c". The second bias resistor R2 is connected between the base electrode "b" and the emitter electrode "e". The base electrode "b" is connected to the second control pin 138 of the delay circuit 130. The emitter electrode "e" receives a second voltage signal from a second input terminal 171. The collector electrode "c" provides the second voltage signal to the gate driver of the LCD via a second output terminal 170. The second voltage signal can be a voltage $V_{GH}$ that is approximately equal to 15 volts.

The third transistor 180 includes a base electrode "b", an emitter electrode "e", and a collector electrode "c". The third bias resistor R3 is connected between the base electrode "b" and the emitter electrode "e". The base electrode "b" is connected to the third control pin 139 of the delay circuit 130. The emitter electrode "e" receives a third voltage signal from a third input terminal 191. The collector electrode "c" provides the third voltage signal to a data driver of the LCD via a third output terminal 190. The third voltage signal can be a voltage $V_{DD}$ that is approximately equal to 9 volts.

Operation of the driving circuit 100 is as follows. When the LCD is turned on, the state machine 133 activates the second transistor 160 via the fifth transistor 135, and keeps the second transistor 160 in an activated state for a first predetermined time period T1. The second output terminal 170 provides the voltage $V_{GH}$ to the gate driver of the LCD when the second transistor 160 is activated. Then the voltage $V_{GH}$ activates a plurality of TFTs (not shown) of the LCD, and electric charges stored in a plurality of pixel capacitors of the LCD are discharged through the activated TFTs.

After the discharging has finished, the state machine 133 activates the third transistor 180 via the sixth transistor 136, and keeps the third transistor 180 in an activated state for a second predetermined time period T2. The third output terminal 190 provides the voltage $V_{DD}$ to the data driver of the LCD when the third transistor 180 is activated. The data driver accordingly provides a plurality of gray-scale voltages to a plurality of pixels of the LCD via the activated TFTs.

Then the state machine 133 activates the first transistor 140 via the fourth transistor 134, and keeps the first transistor 140 in an activated state for a third predetermined time period T3. The first output terminal 150 provides the voltage $V_{GL}$ to the gate driver of the LCD when the first transistor 140 is activated. Then the voltage $V_{GL}$ turns off the TFTs of the LCD.

In summary, the state machine 133 is used to delay the voltage signals $V_{GH}$, $V_{DD}$, $V_{GL}$ for the different predetermined time periods T1, T2, T3. Because the state machine 133 is a digital circuit, the delay time periods T1, T2, T3 can be accurately controlled and are not influenced by environmental temperatures.

It is to be understood, however, that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A driving circuit for a liquid crystal display, comprising:

a first transistor comprising a source electrode, a drain electrode, and a gate electrode, the source electrode configured for receiving a first voltage signal, and the drain electrode configured for providing the first voltage signal to a first circuit of the liquid crystal display;

a first bias resistor connected between the gate electrode and the source electrode of the first transistor;

a second transistor comprising an emitter electrode, a collector electrode, and a base electrode, the emitter electrode configured for receiving a second voltage signal, and the collector electrode configured for providing the second voltage signal to a second circuit of the liquid crystal display;

a second bias resistor connected between the base electrode and the emitter electrode of the second transistor;

a delay circuit, comprising a first control pin connected to the gate electrode of the first transistor, and a second control pin connected to the base electrode of the second transistor, the delay circuit configured for delaying the first voltage signal for a first predetermined time period and the second voltage signal for a second predetermined time period; and a third transistor comprising an emitter electrode, a collector electrode, and a base electrode, the emitter electrode configured for receiving a third voltage signal, and the collector electrode configured for providing the third voltage signal to a third circuit of the liquid crystal display; and a third bias resistor connected between the base electrode and the emitter electrode of the third transistor; wherein the delay circuit further comprises a third control pin connected to the base electrode of the third transistor, and the delay circuit is further configured for delaying the third voltage signal for a third predetermined time period;

wherein the delay circuit further comprises a timing controller, a state machine, a fourth transistor, a fifth transistor, and a sixth transistor, the timing controller is configured for providing an oscillatory signal to the state machine, the state machine comprises three control terminals respectively connected to gate electrodes of the fourth, fifth, and sixth transistors, source electrodes of the fifth and sixth transistors are connected to ground, drain electrodes of the fifth and sixth transistors are respectively defined as the second control pin and the third control pin, a source electrode of the fourth transistor is connected to a power supply, and a drain electrode of the fourth transistor is defined as the first control pin.

2. The driving circuit as claimed in claim 1, wherein the state machine further comprises a counter for generating time delays.

3. The driving circuit as claimed in claim 1, wherein the timing controller comprises an oscillator for providing the oscillatory signal to the state machine.

4. The driving circuit as claimed in claim 1, wherein the third transistor is a PNP (positive-negative-positive) type transistor or a p-channel metal oxide semiconductor field effect transistor.

5. The driving circuit as claimed in claim 1, wherein the sixth transistor is an n-channel metal oxide semiconductor field effect transistor.

6. The driving circuit as claimed in claim 1, wherein the first transistor is an n-channel metal oxide semiconductor field effect transistor or an NPN (negative-positive-negative) type transistor.

7. The driving circuit as claimed in claim 1, wherein the second transistor is a PNP (positive-negative-positive) type transistor or a p-channel metal oxide semiconductor field effect transistor.

8. The driving circuit as claimed in claim 1, wherein the fourth transistor is a p-channel metal oxide semiconductor field effect transistor.

9. The driving circuit as claimed in claim 1, wherein the fifth transistor is an n-channel metal oxide semiconductor field effect transistor.

10. The driving circuit as claimed in claim 1, wherein the first circuit is a gate driver of the LCD.

11. The driving circuit as claimed in claim 1, wherein the second circuit is a data driver of the LCD.

12. The driving circuit as claimed in claim 1, wherein the third circuit is a gate driver of the LCD.

13. A driving circuit for a liquid crystal display, comprising:

a first transistor comprising a source electrode, a drain electrode, and a gate electrode, the source electrode configured for receiving a first voltage signal, and the drain electrode configured for providing the first voltage signal to a first circuit of the liquid crystal display;

a first bias resistor connected between the gate electrode and the source electrode of the first transistor;

a second transistor comprising an emitter electrode, a collector electrode, and a base electrode, the emitter electrode configured for receiving a second voltage signal, and the collector electrode configured for providing the second voltage signal to a second circuit of the liquid crystal display;

a second bias resistor connected between the base electrode and the emitter electrode of the second transistor;

a delay circuit configured for delaying the first voltage signal for a first predetermined time period and the second voltage signal for a second predetermined time period, the delay circuit comprising a timing controller, a state machine, a third transistor, and a fourth transistor, the timing controller configured for providing an oscillatory signal to the state machine, the state machine comprising two control terminals respectively connected to gate electrodes of the third and fourth transistors, a source electrode of the fourth transistor connected to ground, a drain electrode of the third transistor connected to the gate electrode of the first transistor, a source electrode of the third transistor connected to a power supply, a drain electrode of the fourth transistor connected to the base electrode of the second transistor.

14. The driving circuit as claimed in claim 13, wherein the state machine further comprises a counter for generating time delays.

15. The driving circuit as claimed in claim 13, wherein the timing controller comprises an oscillator for providing the oscillatory signal to the state machine.

16. The driving circuit as claimed in claim 13, wherein the second transistor is a PNP (positive-negative-positive) type transistor or a p-channel metal oxide semiconductor field effect transistor.

17. The driving circuit as claimed in claim 13, wherein the fourth transistor is an n-channel metal oxide semiconductor field effect transistor.

18. The driving circuit as claimed in claim 13, wherein the first transistor is an n-channel metal oxide semiconductor field effect transistor or an NPN (negative-positive-negative) type transistor.

* * * * *